US006511945B1

(12) United States Patent
Ramstedt

(10) Patent No.: US 6,511,945 B1
(45) Date of Patent: Jan. 28, 2003

(54) LUBRICANT POWDER FOR POWDER METALLURGY

(75) Inventor: Maria Ramstedt, Helsingborg (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 10/046,714

(22) Filed: Jan. 17, 2002

(30) Foreign Application Priority Data

Oct. 12, 2001 (SE) ..... 0103398

(51) Int. Cl.[7] ..... B22F 1/02; C10M 157/04

(52) U.S. Cl. ..... 508/151; 508/103; 508/454; 508/551; 508/575; 419/38; 75/231; 75/252

(58) Field of Search ..... 508/103, 151, 508/454, 551, 575; 419/38; 75/231, 252

(56) References Cited

U.S. PATENT DOCUMENTS 4,834,800 A 5/1989 Semel
5,290,336 A 3/1994 Luk
5,476,534 A * 12/1995 Ogura et al. ..... 75/252
5,498,276 A 3/1996 Luk
5,744,433 A 4/1998 Storström et al.
5,754,936 A * 5/1998 Jansson ..... 419/35
6,039,784 A 3/2000 Luk
6,126,715 A 10/2000 Luk
6,224,823 B1 5/2001 Lindenau et al.
6,355,208 B1 * 3/2002 Unami et al. ..... 419/11
6,375,709 B1 * 4/2002 Storstrom et al. ..... 75/252

* cited by examiner

*Primary Examiner*—Jacqueline V. Howard
(74) *Attorney, Agent, or Firm*—Burns, Doane, Swecker & Mathis, LLP

(57) ABSTRACT

The invention concerns new lubricants comprising a combination of a polyethylene oxide and an oligomer amide and an improved metallurgical powder composition comprising a major amount of an iron-based powder and a minor amount of this new lubricant. Furthermore, the invention concerns a method requiring low ejection force and low ejection energy for producing green products having high green strength. The method comprises the steps of mixing an iron-based powder and optional additives with the new lubricant and compacting the obtained powder composition.

22 Claims, No Drawings

LUBRICANT POWDER FOR POWDER METALLURGY

FIELD OF THE INVENTION

The present invention relates to new lubricants for metallurgical powder compositions as well as metal-powder compositions containing these lubricants. Specifically the invention concerns iron-based powder composition including the new lubricants as well as compacts, which are made from these compositions and which are distinguished by a high green strength.

BACKGROUND OF THE INVENTION

Green strength is one of the most important physical properties of green parts. The importance of this property increases as P/M parts increase in size and geometry becomes more complex. Green strength increases with increasing compact density and is influenced by type and amount of lubricant admixed to the powder. The green strength is also influenced by the type of powder used. Another possibility of achieve high green strength is to perform the mixing and/or compaction of the metal powder at elevated temperatures. A high green strength is required in order to prevent compacts from cracking during the ejection from the compacting tool and prevent them from getting damaged during the handling and the transport between the press and the sintering furnace. Presently used compacts having a relatively high green strength are advantageously prepared from sponge iron powders whereas difficulties have been met as regards the preparation of compacts of atomised powders in spite of the fact that an atomised powder is more compressible and hence gives a higher green density.

OBJECTS OF THE INVENTION

An object of the present invention is to provide compacted bodies having high green strength and to ensure durability for handling after compaction and ejection from the tool.

A second object is to provide a new lubricant enabling the manufacture of such compacts from highly compressible iron powders, such as atomised iron powders or highly compressible iron-based powders.

A third object is to provide an iron-based powder composition, which includes iron-based powder and the new lubricant.

A fourth object is to provide a method for the preparation of compacted bodies having high green strength when compacted at ambient temperature.

A fifth object is to provide a method for the preparation of green bodies having high strength despite a comparatively low density.

Other objects of the invention will be apparent from the following text.

SUMMARY OF THE INVENTION

It has now been found that the above objects can be attained by new lubricants comprising a combination of a polyethylene oxide and an oligomer amide and the present invention thus concerns such lubricants.

The invention also concerns an improved metal-lurgical powder composition comprising a major amount of an iron-based powder having a weight average particle size in the range of about 25–350 $\mu$m and a minor amount of this new lubricant. Furthermore, the invention concerns a method for producing green bodies having high green strength while maintaining a low ejection force and low ejection energy. Additionally the method ensures durability for handling after compaction and ejection from the tool as evidenced by low Rattler values.

The method comprises the steps of mixing an iron-based powder and optional additives with the new lubricant and compacting the obtained powder composition.

DETAILED DESCRIPTION OF THE INVENTION

More specifically the new lubricant essentially consists of polyethylene oxide (PEO), which belongs to the family of polyethers, in an amount between about 10 and 60% by weight of the lubricant, the remainder being the oligomer amide. In order to obtain the high green strength in combination with low Rattler values the PEO content of the new lubricant should be at least 20 and most preferably at least 30%. When the amount of PEO is above 60% the green strength is reduced. Considering the green strength the highest values are obtained with lubricants including between 30 and 50% of PEO, the balance being the oligomer amide.

The use of polyethers, or more specifically those having low molecular weight commonly called poly-ethylene glycols, in combination with iron-based powders is disclosed in the U.S. Pat. No. 6,224,823, according to which high green strengths may be obtained when the polyethylene glycols have a molecular weight less than 7000 g/mol and the compacting operation is performed at elevated temperature. According to the present invention which is concerned with the preparation of green bodies by compacting the powders at ambient temperature (normally about 15 to about 35° C.) it has been found that poly ethylene oxides having molecular weights above 7000 g/mol has unexpected advantages if combined with the oligomer amides.

Suitable polyethylene oxides which may be used according to the present invention are disclosed in the U.S. Pat. No. 5,498,276 which is hereby incorporated by reference. These polyethylene oxides are solid, particulate substances having a weight average molecular weight between about 10,000 and about 4,000,000.

According to the present invention the polyethylene oxide should preferably have a weight average molecular weight between about 20,000 and about 400,000 g/mol. Most preferably the oxide should have a weight average molecular weight between 50,000 and 300,000 g/mol. Examples of preferred materials are oxides having a molecular weight of 100,000 g/mol or 200,000 g/mol. If the molecular weight is less than 20,000 green strength will not be sufficiently high and if the molecular weight exceeds 400000 g/mol particles within the desired size range cannot be obtained with conventional methods.

The use of PEO in connection with powder metal compositions is also from the U.S. Pat. Nos. 5,290,336, 6,126,715 and 6,039,784. These patents teaches i.a. that PEO may be as an agent for improving the green strength and reducing the ejection force. It is also disclosed that PEO may be mixed with various lubricants such as stearates and waxes. According to the U.S. Pat. No. 5,498,276 the PEO should preferably be used in amounts of at least 90 of 100% of the lubricant used in the composition.

In contrast to this teaching it has now been found that, in order to achieve the unexpected results according to the present invention, the PEO should be used in amounts less than 90% and that the PEO should be combined with an oligomer amide, whereas combinations of PEO with various types of other commonly used lubricants, such as ethylene bisstearamide as suggested in the above patents, have not been successful.

The oligomer amides, which are used according to the present invention, are known from the U.S. Pat. No. 5,744,433 which is hereby incorporated by reference. According to this patent the oligomers are used as lubricants in metal powder compositions. These oligomers have a weight-average molecular weight $M_W$ of 30,000 at the most and, preferably, at least 1,000. Additionally these oligomer amides have a melting point peak in the range of 120° to 200° C. Most preferably $M_W$ varies between 2,000 and 20,000. It is also taught that at least 80% of the lubricant, preferably at least 85% and most preferably 90% by weight of the lubricant, is made up of the oligomer amide.

Furthermore the U.S. Pat. No. 5744433 teaches that these amides are used for warm compaction. When using these amides for cold compaction, i.e. compaction at ambient temperature, the ejection force will be too high for industrial use. This is in contrast to the present invention according to which the oligomer amides in combination with PEO are advantageously used for cold compaction whereas inferior results are obtained when the powder compositions are compacted at elevated temperatures.

As used in the description and the appended claims, the expression "iron-based powder" encompasses powder essentially made up of pure iron; iron powder that has been prealloyed with other substances improving the strength, the hardening properties, the electromagnetic properties or other desirable properties of the end products; and particles of iron mixed with particles of such alloying elements (diffusion annealed mixture or purely mechanical mixture). Examples of alloying elements are copper, molybdenum, chromium, manganese, phosphorus, carbon in the form of graphite, and tungsten, which are used either separately or in combination, e.g. in the form of compounds ($Fe_3P$ and FeMo). Unexpectedly good results are obtained when the lubricants according to the invention are used in combinations with atomised iron-based powders having high compressibility. Generally, such powders have a low carbon content, preferably below 0.04% by weight. Such powders include e.g. Distaloy AE, Astaloy Mo and ASC 100.29, all of which are commercially available from Hoganas AB, Sweden. Furthermore, high green strength and low Rattler values can be obtained for green bodies containing sponge iron powders and the new lubricant, which have been compressed to a relatively low green density.

Apart from the iron-based powder and the lubricant according to the invention, the powder composition may contain one or more additives selected from the group consisting of binders, processing aids and hard phases. The binder may be added to the powder composition in accordance with the method described in U.S. Pat. No. 4,834,800 (which is hereby incorporated by reference).

The binder used in the powder composition may consist of e.g. cellulose ester resins, hydroxyalkyl cellulose resins having 1–4 carbon atoms in the alkyl group, or thermoplastic phenolic resins.

The processing aids used in the metal-powder composition may consist of talc, forsterite, manganese sulphide, sulphur, molybdenum disulphide, boron nitride, tellurium, selenium, barium difluoride and calcium difluoride, which are used either separately or in combination.

The hard phases used in the powder composition may consist of carbides of tungsten, vanadium, titanium, niobium, chromium, molybdenum, tantalum and zirconium, nitrides of aluminium, titanium, vanadium, molybdenum and chromium, $Al_2O_3$, $B_4C$, and various ceramic materials.

With the aid of conventional techniques, the iron-based powder and the lubricant particles are mixed to a substantially homogeneous powder composition.

Preferably, the lubricant composition according to the invention is added to the metal-powder composition in the form of solid, micronized particles. The average particle size of the lubricant may vary but is preferably below 150 $\mu$m and most preferably in the range of 3–100 $\mu$m. If the particle size is too large, it becomes difficult for the lubricant to leave the pore structure of the metal-powder composition during compaction and the lubricant may then give rise to large pores after sintering, resulting in a compact showing impaired strength properties. If on the other hand the particle size is too small the lubrication and flow will deteriorate and the ejection energy will be too high.

The amount of the new lubricant used for the compaction of the powder composition may be at most 2% by weight of the composition. Preferably the amount varies between 0.2 and 1.5% by weight.

According to the present invention it is possible to obtain compacts having a green strength above 20 and even above 27 MPa without the requirement of high ejection force and/or high ejection energy when the compaction process is performed at ambient temperature (about 20° C.) and at pressures of about 600 MPa. In the context of the present invention "high ejection force" may be defined as more than 15 $N/mm^2$ and "high ejection energy" may be defined as more than 35 $J/cm^2$.

An important and advantageous feature is that high green strengths and low material losses (low Rattler values) may even be obtained when compositions including the new lubricant are mixed and compacted at ambient temperature to comparatively low densities, e.g. about 5.5–6.5 $g/cm^3$.

When sintering the green compacts products having good mechanical properties can be obtained. The sintering may be performed under conventional conditions.

EXAMPLES

The following examples, which are not intended to be limiting, present certain embodiments and advantages of the present invention. Unless otherwise indicated, any percentages are on a weight basis.

In each of the examples, the powders that constitute the powder composition were mixed at ambient temperature (about 20° C.) for 2 minutes in a Gebruder Lödige apparatus.

The powder compositions were then compacted at ambient temperature into green bars in a die at the pressure indicated, followed by sintering in a 90/10 (90% $N_2$ and 10% $H_2$) atmosphere for about 30 minutes at temperatures of about 1120° C. at a C potential of 0.5%.

Physical properties of powder mixtures and of the green and sintered bars were determined generally in accordance with the following test methods and formulas:

| Property | Test method |
|---|---|
| AD | ISO 3923/s, SS EN23923-1 |
| Flow | ISO 4490 |
| Compation- Tensile test bar type N | ISO2740 |
| Compation- Tensile test bar type TRS | ISO3325 |
| Hardness Rockwell | SS EN10109-1 |
| Tensile strength (TS, Y.str.) | SS EN10002-1 |
| Dimensional change and springback | SS EN24492, ISO4492 |
| GD and SD | SS EN 23927, ISO 3927 |
| GS | SS EN23995 |
| Rattler | JSPM4-69 |

Ejection force as defined here is a static force that must be overcome to initiate ejection of a compacted part from a die. It is calculated as the quotient of the load needed to start the ejection and the cross-sectional area of the part that is in contact with the die surface, and is reported in units of $N/mm^2$.

Ejection energy as defined here is the integral of the force applied on the compacted body in order to continue the ejection and eject the compacted body with respect to the total ejected distance divided by the surface that is in contact with the die surface. The ejection energy is reported in units of $J/cm^2$.

Example 1

This example demonstrates the importance of using lubricant combinations according to the invention and that inferior results are obtained when using amounts of PEO less than 10% or higher than 60% in the lubricant composition.

Atomised iron powder, 2% of Cu powder, 0.5% graphite and 0.8% of the new lubricant were mixed. The iron powder was ASC 100.29 available from Höganäs AB, Sweden, the Cu powder had a mean particle size of 75 $\mu$m and the graphite powder had a mean particle size of 5 $\mu$m. The new lubricant was made up by an oligomer amide, Orgasol® having a weight average molecular weight of 6000 and a PEO having a mean molecular weight of 100,000 or 200,000. The micronized lubricant was sieved to maintain an average particle size less than 75 $\mu$m.

5 different lubrication samples including the new lubricant having the composition shown in the following

TABLE 1

| Composition No. | 1 | 2 | 3 | 4 | 5 |
|---|---|---|---|---|---|
| Orgasol | 0 | 50 | 60 | 80 | 100 |
| PEO | 100 | 50 | 40 | 20 | 0 |

As a reference ethylene bissteramide frequently abbreviated EBS was used.

The mixtures were mixed for 2 minutes in a Gebruder L ödige apparatus with the sample lubricants 1–5 and each powder mix was investigated as regards apparent density, flow, green density (at 600 MPa), sintered density, ejection force, ejection energy, spring back, dimensional change, green strength, Rattler value, tensile strength and yield strength. The sintering was carried out at 1120° C.×30 min. The atmosphere was 90/10 (90%$N_2$ and 10%$H_2$). The results are disclosed in table 2.

TABLE 2

| Composition No | Ref. | 1 | 2 | 3 | 4 | 5 |
|---|---|---|---|---|---|---|
| AD24 ($g/cm^3$) | 2.99 | 2.94 | 3.00 | 2.96 | 2.98 | 2.89 |
| Flow (s/50 g) | 31.14 | 24.48 | 26.39 | 28.15 | 28.84 | 31.95 |
| GD ($g/cm^3$) | 7.07 | 7.02 | 7.03 | 7.04 | 7.02 | 7.08 |
| SD ($g/cm^3$) | 6.96 | 6.88 | 6.90 | 6.90 | 6.91 | 6.94 |
| Ej. Force ($N/mm^2$) | 11.10 | 19.70 | 15.70 | 15.40 | 19.70 | 19.70 |
| Ej. Energy ($J/cm^2$) | 23.10 | 46.20 | 32.50 | 31.30 | 42.10 | 59.00 |
| Spring back (%) | 0.30 | 0.24 | 0.32 | 0.31 | 0.36 | 0.31 |
| Dim. Change (%) | 0.66 | 0.68 | 0.69 | 0.71 | 0.66 | 0.66 |
| GS (MPa) | 14.90 | 25.59 | 23.09 | 27.43 | 24.03 | 31.19 |
| Rattler (%) | 0.73 | 0.20 | 0.20 | 0.22 | 0.23 | 0.28 |
| TS (MPa) | 465 | 413.6 | | 452.6 | 470 | 467.3 |
| Y. str. (MPa) | 335 | 307 | | 322 | | 332 |

The above results demonstrate that by using the lubricant compositions according to the present invention unexpectedly low values of the ejection force and ejection energy can be obtained. These properties in combination with the obtained high green strength and low Rattler values show that we have been able to find lubricant compositions with superior properties with regard to properties necessary for the durability when handling and transporting green bodies.

Example 2

This example demonstrates the effect obtained when the polyethylene oxide was mixed with the frequently used EBS (ethylene bisstearamide). The test was performed as in example 1 with the same powder and the same amounts of the lubricant. From the following table 3 it can be seen that essentially no improvement of the green strength is obtained when PEO is mixed with EBS.

TABLE 3

| | 100% EBS | 20% PEO + 80% EBS | 20% PEO + 80% Orgasol |
|---|---|---|---|
| AD ($g/cm^3$) | 2,99 | 3,1 | 2.98 |
| Flow (s/50 g) | 31,14 | 25,21 | 28.84 |
| GD ($g/cm^3$) | 7,07 | 6,97 | 7.02 |
| GS (MPa) | 14,90 | 15,34 | 19.70 |
| Rattler (%) | 0,73 | 0,54 | 0.23 |

Example 3

This example demonstrates that high green strength values can be obtained also for green bodies having comparatively low densities i.e. the powder compositions have been compacted at low pressures. The following mixes were prepared.

TABLE 4

| | |
|---|---|
| MIX 1 | NC100.24 + 20% Cu + 0,75% (PEO/Orgasol 20/80) |
| MIX 2 | NC100.24 + 20% Cu + 0,75% Zina stearate |
| MIX 3 | MH 80.23 + 20% Cu + 0,75% (PEO/Orgasol 20/80) |
| MIX 4 | MH 80.23 + 20% Cu + 0,75% Zinc stearate |

NC100.24 is a sponge iron powder from Höganäs AB, Sweden.
MH 80.23 is a sponge iron powder from Höganäs AB, Sweden The mixes 1 and 3 included 20% PEO and 80% Orgasol. The mixes 2 and 4 including the zinc stearate were used as references. The mixes were compacted at a compacting pressure of 230 MPa. As can be seen from the following table 5 high green strength can be obtained also for compacts having comparatively low green density. The low Rattler values demonstrate that the durability for handling after compaction and ejection from the tool of the green bodies obtained according to the present invention is comparatively very high.

TABLE 5

| | MIX 1 | MIX 2 | MIX 3 | MIX 4 |
|---|---|---|---|---|
| Green Strength (MPa) | 14.61 | 5.88 | 13.47 | 6.63 |
| Rattler (%) | 0.44 | 1.36 | 0.26 | 0.99 |
| Green density ($g/cm^3$) | 5.91 | 6.09 | 5.73 | 5.88 |

What is claimed is:

1. Lubricant for powder metallurgical compositions consisting essentially of 10–60% by weight of a polyethylene oxide polymer the remainder being an oligomer amide.

2. Lubricant according to claim 1 wherein the polyethylene oxide polymer content is 20–50% by weight.

3. Lubricant according to claim 1 wherein it is in the form of a micronized powder.

4. Lubricant according to claim 3 wherein the lubricant has a weight average particle size below about 150 $\mu$m.

5. Lubricant according to claim 1 wherein the polyethylene oxide polymer has a weight average molecular weight of about 20,000 to 400,000 g/mol.

6. Lubricant according to claim 1 wherein the oligomer amide has a weight average molecular weight of about 2,000 to 20,000 g/mol.

7. An improved metallurgical powder composition comprising a major amount of an iron-based powder having a weight average particle size in the range of about 25–350 $\mu$m and a minor amount of a solid particulate lubricant according to claim 1.

8. A powder composition according to claim 7 including at most 2% by weight of lubricant.

9. A powder composition according to claim 8, wherein the lubricant powder is provided in a concentration 0.2 to 1.5% by weight of the composition.

10. A powder composition according to claim 7 which additionally contains one or more additives selected from the group consisting of binders, processing aids, and hard phases.

11. A powder composition according to claim 7, wherein the iron-based powder comprises an atomised powder.

12. A method for producing green products having a high strength comprising:

(a) mixing an iron-based powder with a lubricant powder according to claim 1 and (b) compacting the metal-powder composition at ambient temperature.

13. Lubricant according to claim 2 wherein it is in the form of a micronized powder.

14. Lubricant according to claim 2 wherein the polyethylene oxide polymer has a weight average molecular weight of about 20,000 to 400,000 g/mol.

15. Lubricant according to claim 3 wherein the polyethylene oxide polymer has a weight average molecular weight of about 20,000 to 400,000 g/mol.

16. Lubricant according to claim 4 wherein the polyethylene oxide polymer has a weight average molecular weight of about 20,000 to 400,000 g/mol.

17. Lubricant according to claim 2 wherein the oligomer amide has a weight average molecular weight of about 2,000 to 20,000 g/mol.

18. An improved metallurgical powder composition comprising a major amount of an iron-based powder having a weight average particle size in the range of about 25–350 $\mu$m and a minor amount of a solid particulate lubricant according to claim 2.

19. A powder composition according to claim 8 which additionally contains one or more additives selected from the group consisting of binders, processing aids, and hard phases.

20. A powder composition according to claim 8, wherein the iron-based powder comprises an atomised powder.

21. Lubricant according to claim 1 wherein the polyethylene oxide polymer content is 30–50% by weight.

22. Lubricant according to claim 3 wherein the lubricant has a weight average particle size between 3 and 100 $\mu$m.

* * * * *